US011882940B2

(12) United States Patent
Murata

(10) Patent No.: US 11,882,940 B2
(45) Date of Patent: Jan. 30, 2024

(54) CUSHION BODY FOR SITTING

(71) Applicant: JSP Corporation, Tokyo (JP)

(72) Inventor: Seishiro Murata, Tokyo (JP)

(73) Assignee: JSP Corporation, Tokyo (JP)

( * ) Notice: Subject to any disclaimer, the term of this patent is extended or adjusted under 35 U.S.C. 154(b) by 114 days.

(21) Appl. No.: 17/632,911

(22) PCT Filed: Aug. 4, 2020

(86) PCT No.: PCT/JP2020/029782
§ 371 (c)(1),
(2) Date: Feb. 4, 2022

(87) PCT Pub. No.: WO2021/025007
PCT Pub. Date: Feb. 11, 2021

(65) Prior Publication Data

US 2022/0273102 A1 Sep. 1, 2022

(30) Foreign Application Priority Data

Aug. 5, 2019 (JP) ..... 2019-143968

(51) Int. Cl.
*A47C 7/02* (2006.01)
*A47C 7/18* (2006.01)
*A47C 27/14* (2006.01)

(52) U.S. Cl.
CPC ..... *A47C 7/029* (2018.08); *A47C 27/14* (2013.01)

(58) Field of Classification Search
CPC ..... A47C 7/029; A61G 5/1045
(Continued)

(56) References Cited

U.S. PATENT DOCUMENTS 1,742,186 A * 1/1930 Claus ..... A47C 7/029 5/653
D169,366 S * 4/1953 Feldman ..... 297/452.26 X
(Continued)

FOREIGN PATENT DOCUMENTS

CN 109068864 A 12/2018
DE 102011016346 A1 * 10/2012 ..... A47C 27/085
(Continued)

OTHER PUBLICATIONS

Office Action dated Apr. 22, 2023 in corresponding CN App. No. 202080054250.7.
(Continued)

*Primary Examiner* — Rodney B White
(74) *Attorney, Agent, or Firm* — FITCH, EVEN, TABIN & FLANNERY, LLP

(57) ABSTRACT

A cushion body for sitting is provided which can offer good feeling of sitting even to many unspecified users of various body shapes and allow them to be seated more comfortably. A cushion body for sitting (1) includes: a base part (2) having a sitting surface (S1) formed of a curved surface that is curved concavely to support, from below, the buttocks of a seated person in a seated posture; and a pair of side supporting portions (3) each having a side supporting surface (S2) formed of a curved surface that is curved continuously from the sitting surface (S1) of the base part (2), where the pair of side supporting portions (3) project from sides of the base part (2) such that the side supporting portions (3) can be bent and deformed by a load applied to the side supporting surfaces (S2), so as to support both the left and right parts of the buttocks of the seated person in the seated posture.

20 Claims, 15 Drawing Sheets

(58) Field of Classification Search
USPC ..... 297/452.22, 452.21, 452.23, 452.24, 297/452.25, 452.26
See application file for complete search history.

(56) References Cited

U.S. PATENT DOCUMENTS 2,659,418 A * 11/1953 Berman ..... A47C 7/021 5/730
3,376,070 A * 4/1968 Johnson ..... A47C 7/029 297/452.25 X
3,611,455 A * 10/1971 Gottfried ..... B63C 9/08 601/24
4,132,228 A * 1/1979 Green ..... A47C 7/029 297/452.26 X
D278,779 S * 5/1985 Sink ..... 5/653
4,588,229 A * 5/1986 Jay ..... A61G 7/05715 297/452.25 X
4,643,481 A * 2/1987 Saloff ..... A61G 7/05715 297/452.25 X
4,726,624 A * 2/1988 Jay ..... A61G 5/1043 297/452.25 X
D318,923 S * 8/1991 Marsh ..... D6/601
5,079,790 A * 1/1992 Pouch ..... A61G 7/05784 5/653
5,288,135 A * 2/1994 Forcier ..... A61G 5/1064 297/452.21 X
5,343,876 A * 9/1994 Rogers ..... A47C 7/029 128/845
5,395,162 A * 3/1995 Jay ..... A47C 7/021 297/452.25 X
5,397,517 A * 3/1995 Jay ..... B29C 44/06 264/46.7
5,522,106 A * 6/1996 Harrison ..... A47C 7/029 297/452.25 X
5,687,436 A * 11/1997 Denton ..... A61G 5/1045 297/452.25 X
5,833,319 A * 11/1998 Davis ..... A47C 7/425 297/452.21 X
6,142,573 A * 11/2000 Harding ..... A47C 7/029 297/452.25 X
6,241,320 B1 * 6/2001 Chew ..... A47C 7/021 297/452.26 X
D463,701 S * 10/2002 Borcherding ..... D6/601
6,502,263 B1 * 1/2003 Rowley ..... A47C 7/021 297/452.25 X
6,990,744 B2 * 1/2006 Bieganek ..... A47C 7/029 33/515
7,140,057 B2 * 11/2006 Hetzel ..... A61G 5/1043 297/452.26 X
7,216,388 B2 * 5/2007 Bieganek ..... A47C 7/029 297/452.26 X
7,373,678 B2 * 5/2008 Hetzel ..... A47C 7/021 297/452.26 X
7,891,033 B2 * 2/2011 Loewenthal ..... A61G 5/1043 297/452.21
8,713,733 B2 * 5/2014 Caforio ..... A47C 7/144 5/640
9,220,345 B2 * 12/2015 Davis ..... A47C 7/029
9,723,928 B2 * 8/2017 Krishtul ..... A47C 7/18
9,763,521 B2 * 9/2017 Krishtul ..... A47C 7/021
10,111,526 B2 * 10/2018 Davis ..... A47G 9/10
10,455,944 B2 * 10/2019 Chernin ..... A61G 5/124
D868,501 S * 12/2019 Mi ..... D6/601
10,717,370 B2 * 7/2020 Hisamatsu ..... A47C 7/029
D904,075 S * 12/2020 Krishtul ..... D6/601
10,905,255 B1 * 2/2021 Miale ..... B60N 2/914
D915,104 S * 4/2021 Yang ..... D6/601
D923,358 S * 6/2021 Leverett ..... D6/601
2001/0013146 A1 * 8/2001 Wempe ..... A61G 5/1043 5/654
2002/0017733 A1 2/2002 Kobayashi et al.
2003/0121103 A1 * 7/2003 Wempe ..... A61G 5/1045 5/654
2004/0160111 A1 * 8/2004 Koffler ..... A47C 7/029 297/452.25 X
2005/0023872 A1 * 2/2005 Hetzel ..... A61G 5/1043 297/256.16
2006/0150338 A1 * 7/2006 Jackson, III ..... A61G 5/1043 5/655.3
2007/0028385 A1 2/2007 Hetzel et al.
2007/0157391 A1 * 7/2007 Jackson, III ..... A61G 13/0054 5/713
2009/0295203 A1 * 12/2009 Lewis ..... A61G 5/1045 297/219.1
2012/0068507 A1 * 3/2012 Debevec ..... A47D 1/103 297/250.1
2013/0060282 A1 * 3/2013 Pham ..... A47C 7/029 606/242
2013/0113264 A1 * 5/2013 Pham ..... A47C 31/126 297/452.21
2019/0099002 A1 4/2019 Murata et al.

FOREIGN PATENT DOCUMENTS

JP H8-140784 A 4/1996
JP H08-140784 A 6/1996
JP H10-192094 A 7/1998
JP 2004-113637 A 4/2004
JP 2006-149471 A 6/2006
JP 2006-150090 A 6/2006
JP 2013-159722 A 8/2013
JP 2015-181912 A 10/2015
JP 2016-093461 A 5/2016
JP 2017-121334 A 7/2017
JP 2017-185193 A 10/2017
KR 101056058 B1 * 8/2011 ..... A47V 7/029
KR 20110125800 A * 11/2011 ..... A47C 7/029
KR 101134572 B1 * 4/2012 ..... A47C 7/029
KR 2018032050 A * 3/2018 ..... A44B 18/00
KR 2019026087 A * 3/2019 ..... A47C 7/021
KR 2019066131 A * 6/2019 ..... A47C 3/16
KR 2020000061 U * 1/2020 ..... A47C 7/021
WO WO-9639908 A1 * 12/1996 ..... A47C 31/126
WO 2015/080231 A1 4/2015
WO 2015/080231 A1 6/2015
WO 2015/147268 A1 10/2015
WO 2017/170941 A 5/2017
WO 2017/170941 A1 10/2017

OTHER PUBLICATIONS

International Search Report for PCT/JP2020/029782 dated Oct. 13, 202; 4 pages.
International Search Report dated Oct. 13, 2020 in International Appln. No. PCT/JP2020/029782.
Written Opinion of International Searching Authority dated Feb. 17, 2022 in International Application No. PCT/JP2020/029782.
Extended European Search Report dated Jul. 14, 2023 in corresponding European Patent Appln. No. 20849852.7.

* cited by examiner

CUSHION BODY FOR SITTING

CROSS-REFERENCE TO RELATED APPLICATIONS

This application is a U.S. national phase application filed under 35 U.S.C. § 371 of International Application No. PCT/JP2020/029782, filed Aug. 4, 2020, which claims priority from Japanese Application No. 2019-143968, filed Aug. 5, 2019, which are both incorporated herein by reference in their entireties.

TECHNICAL FIELD

The present invention relates to a cushion body for sitting which is for enabling more comfortable sitting.

BACKGROUND ART

Plate-shaped seat cushions made of flexible cushion materials, such as soft urethane foams or fiber cushion materials, have conventionally been known, which easily deform compressively when loaded with the body weight of the seated person. When a user sits on such a seat cushion, the seat cushion sinks due to the body weight to form a concavity resembling the shape of the buttocks, thus dispersing the body pressure of the seated person.

However, depending on the shape of the cushion material and the body weight of the seated person, compressive deformation of the cushion material may be insufficient to adequately disperse the body pressure, or the cushion material may be unable to sink enough and abuts the bottom surface, which will strongly compress the areas around the ischial tuberosities and result in numbness or pain in some cases. The seated person then feels uncomfortable and may even feel pain, and sitting for a long time becomes a great burden.

On the other hand, Patent Literature 1 proposes using a base material which forms a three-dimensional shape fitting the contour of a user's body part supported thereby and which has both rigidity and flexibility as a supporting structure so that a cushion material covering the base material can deform to fit the body shape of the seated person when loaded with the user's body weight.

CITATION LIST

Patent Literature

[Patent Literature 1] JP 2017-121334 A

SUMMARY OF INVENTION

Technical Problem

However, in Patent Literature 1, the base material is a plate-like molded body made by molding a synthetic resin plate or the like, and therefore has high rigidity that only enables slight deflection deformation only within a limited range. It is thus difficult to make the cushion material deform to fit the body shapes of many unspecified users with various body shapes, making it impossible to obtain a good body pressure dispersing property.

The present invention has been devised considering the aforementioned circumstances and an object of the present invention is to provide a cushion body for sitting which can offer good feeling of sitting to many unspecified users of various body shapes and allow them to be seated more comfortably.

Solution to Problem

The cushion body for sitting according to the present invention provides a cushion body for sitting made of an expanded beads molded body, including: a base part having a sitting surface formed of a curved surface that is curved concavely to support, from below, the buttocks of a seated person in a seated posture; and a pair of side supporting portions each having a side supporting surface formed of a curved surface that is curved continuously from the sitting surface, where the pair of side supporting portions project from sides of the base part such that the side supporting portions can be bent and deformed outward by a load applied to the side supporting surfaces so as to support both left and right parts of the buttocks of the seated person in the seated posture, and where the expanded beads molded body shows a load of 10 to 150 N with a bending deflection of 20 mm when measured according to an operation described in JIS K 7221-1: 2006, and the expanded beads molded body shows a 25% compressive stress of 0.08 to 7 MPa when measured according to an operation described in JIS K 6767: 1999.

Advantageous Effects of Invention

According to the present invention, it is possible to offer a superior body pressure dispersing property even to many unspecified users of various body shapes and to present suitable supporting performance to guide a seated person into a proper seated posture with less load on their body. This can impart good feeling of sitting and allows comfortable sitting even for a long time.

DESCRIPTION OF EMBODIMENTS

Preferred embodiments of the present invention are described with reference to the drawings.

First Embodiment

First, a first embodiment of the present invention will be described.

Figure 1:
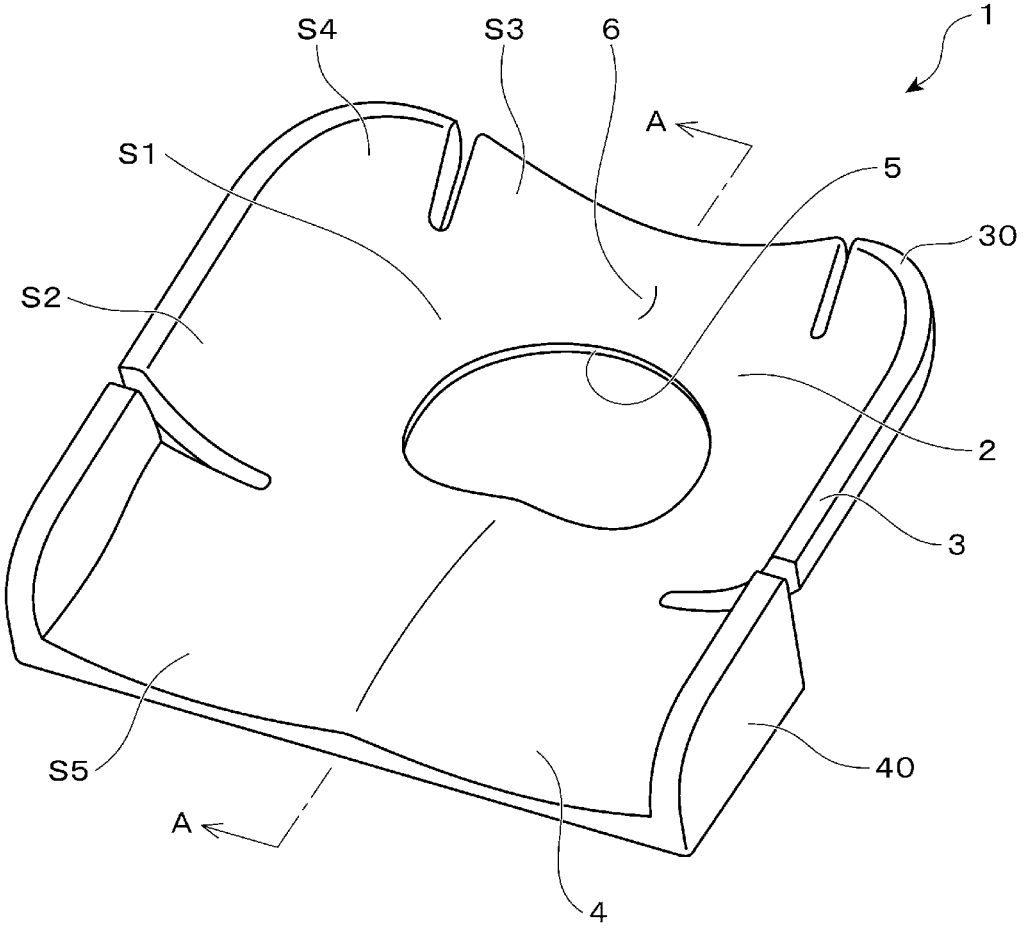
FIG. 1 A perspective view schematically illustrating a cushion body for sitting according to a first embodiment of the present invention.
Figure 2:
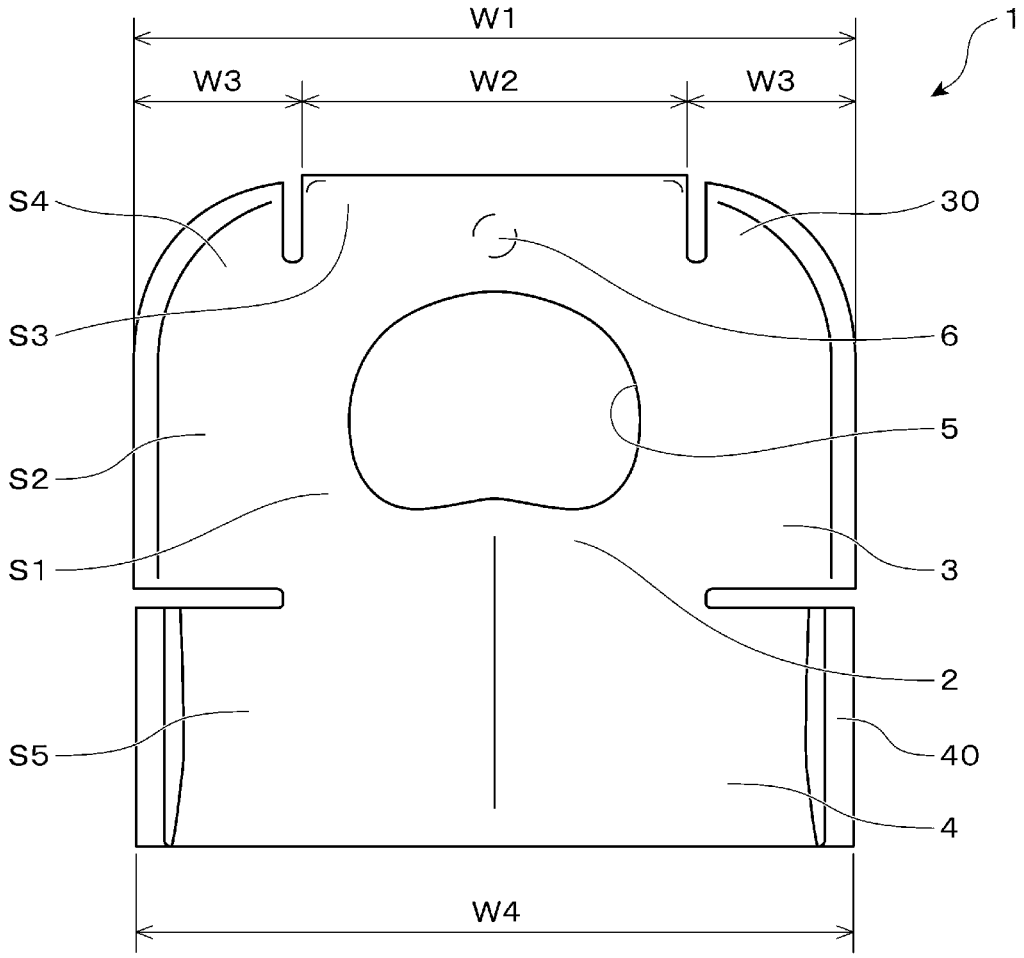
FIG. 2 A plan view schematically illustrating the cushion body for sitting according to the first embodiment of the present invention.
Figure 3:
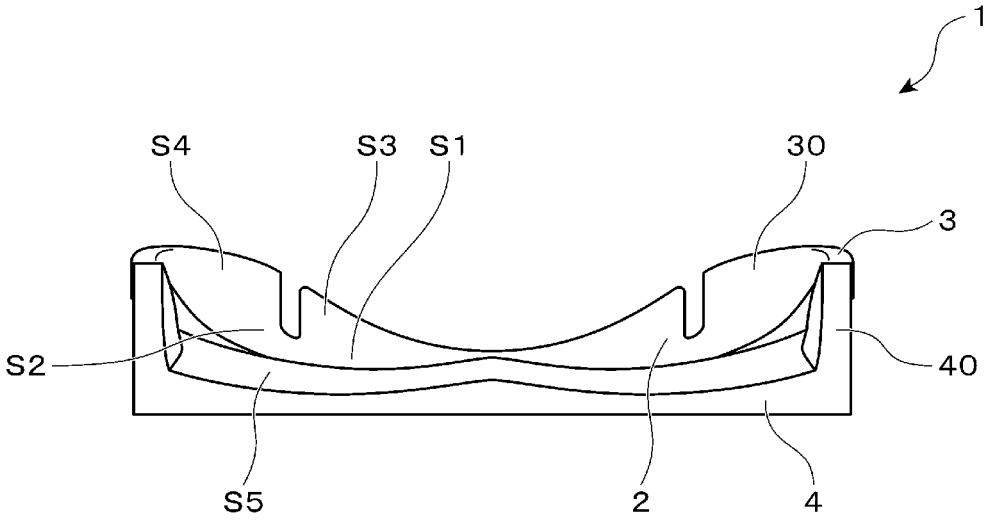
FIG. 3 A front view schematically illustrating the cushion body for sitting according to the first embodiment of the present invention.
Figure 4:
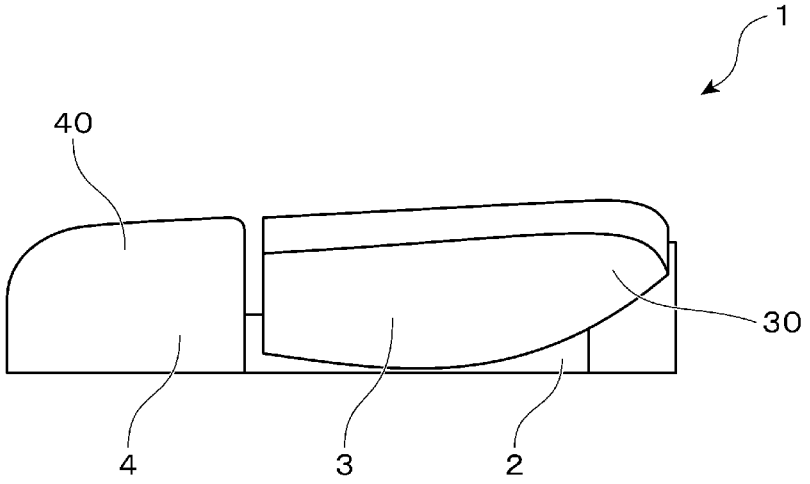
FIG. 4 A side view schematically illustrating the cushion body for sitting according to the first embodiment of the present invention.
Figure 5:
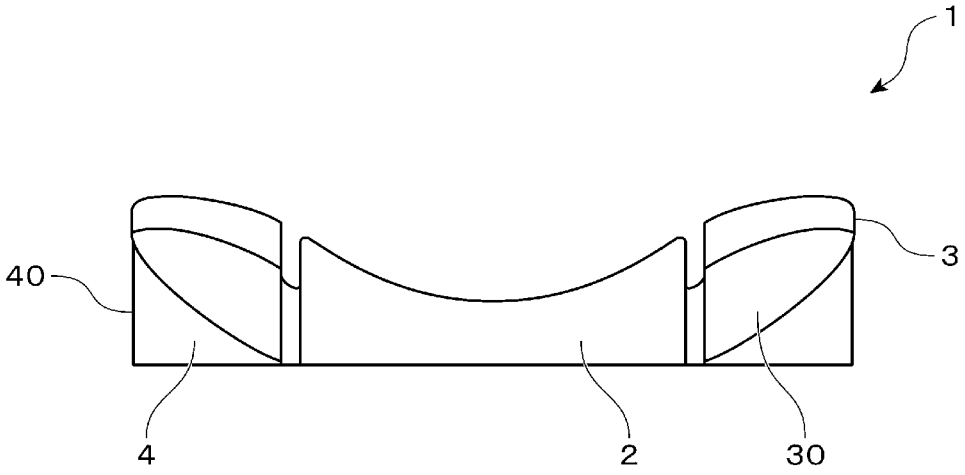
FIG. 5 A rear view schematically illustrating the cushion body for sitting according to the first embodiment of the present invention.
Figure 6:
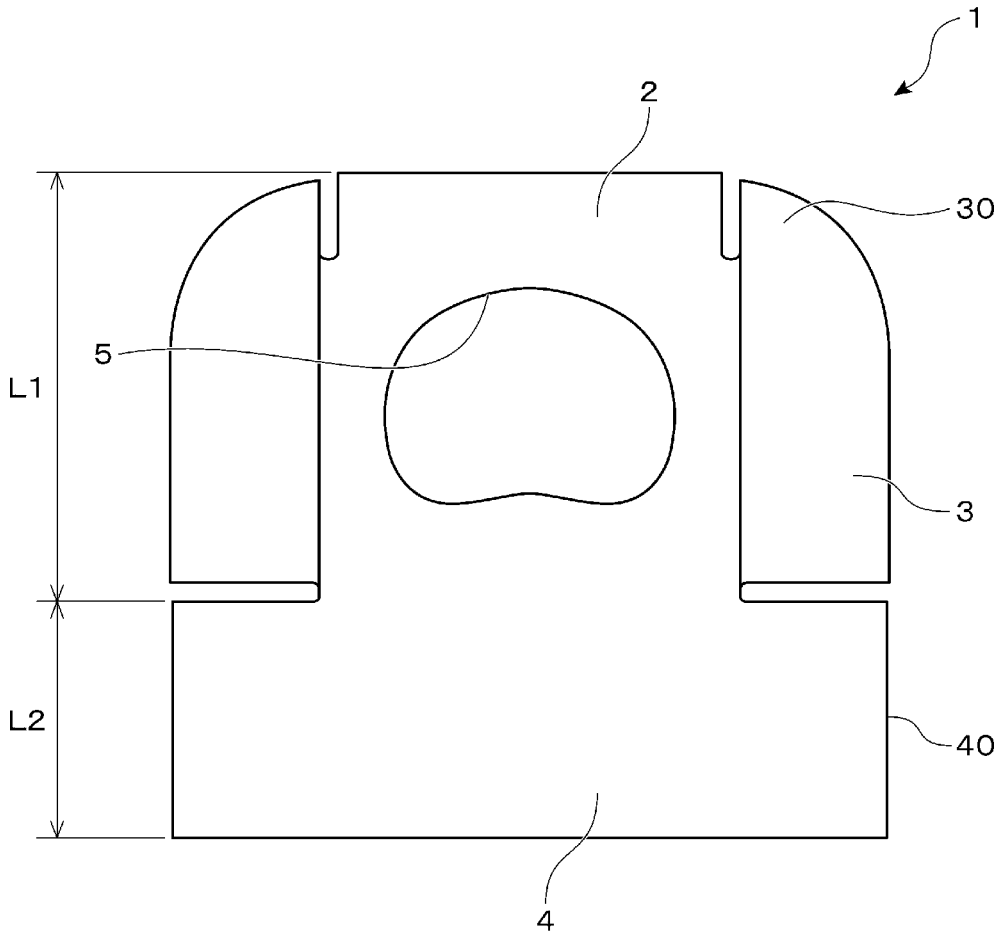
FIG. 6 A bottom view schematically illustrating the cushion body for sitting according to the first embodiment of the present invention.
Figure 7:
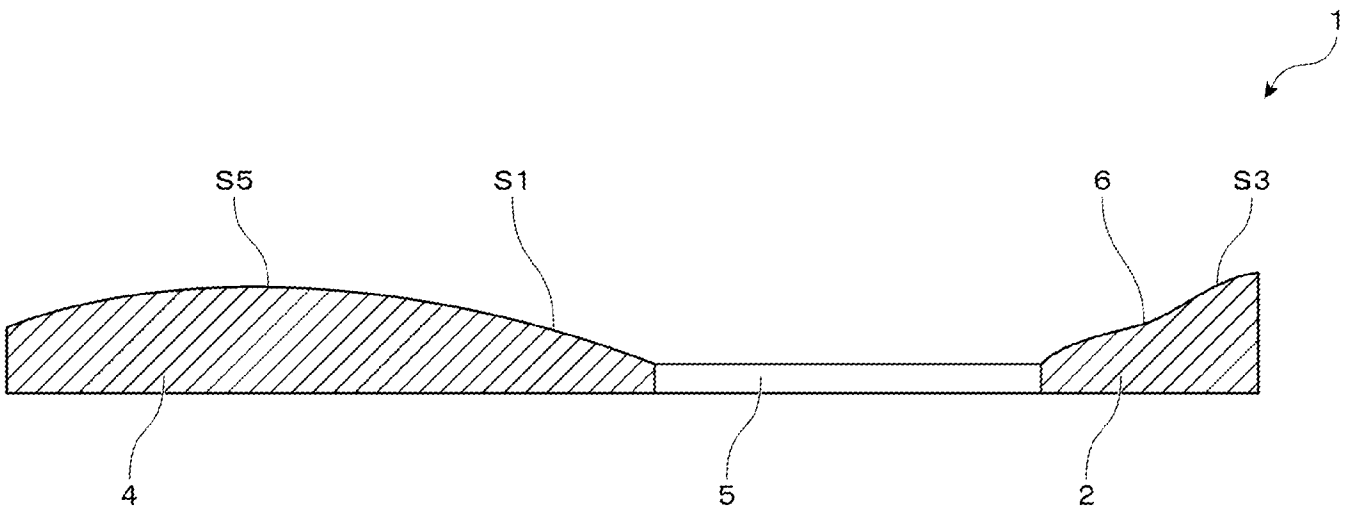
FIG. 7 An end view taken along line A-A in FIG. 1.

FIG. 1 is a perspective view schematically illustrating a cushion body 1 for sitting in accordance with this embodiment, FIG. 2 is a plan view thereof, FIG. 3 is a front view thereof, FIG. 4 is a side view thereof, FIG. 5 is a rear view thereof, FIG. 6 is a bottom view thereof, and FIG. 7 is an end view taken along A-A in FIG. 1.

The cushion body 1 for sitting shown in these drawings illustrates an example that is configured to be placed on the seat surface of existing chairs that are, for example, chairs used at home, in offices, or for leisure, chairs used in theaters, seats for relieving lower-back pain, the seats of wheelchairs, etc., and to provide more comfortable sitting when a user sits thereon.

The cushion body 1 for sitting includes: a base part 2 having a sitting surface S1 formed of a curved surface that is curved concavely to support, from below, the buttocks of a seated person in a seated posture; and a pair of side supporting portions 3 having side supporting surfaces S2 each formed of a curved surface that is curved continuously from the sitting surface S1 of the base part 2, where the pair of side supporting portions 3 project from sides of the base part 2 so that they can be bent and deformed by the load applied to the side supporting surfaces S2, in order to support both the left and right parts of the buttocks of the seated person in the seated posture.

Herein, front-rear, left-right, and top-bottom directions about the cushion body 1 for sitting are defined based on the posture of the seated person sitting on the cushion body 1 for sitting so that they correspond to the front-rear, left-right, and top-bottom directions seen from the seated person in the seated posture.

The "front", "rear", and "sides" of the cushion body 1 for sitting can be determined around the positions of the ischial tuberosities of the seated person.

The cushion body 1 for sitting is made of a relatively hard expanded beads molded body. Such a molded body can be produced by preparing thermoplastic resin expanded beads that have been foamed with a given expansion ratio, for example, by using a thermoplastic resin, such as a polyolefin resin such as a polyethylene resin or a polypropylene resin, a polystyrene resin, or a composite resin of polyolefin resin and polystyrene resin, and then in-mold molding the expanded beads under heat and pressure to thermally fuse the expanded beads together.

For the base resin of the expanded beads molded body, a composite resin of a polypropylene resin or a polyolefin resin and a polystyrene resin is preferred, and a polypropylene resin is more preferred. In this case, it is easy to obtain an expanded beads molded body having desired physical bending properties and compressibility so that the side supporting portions 3 and a rear supporting portion 20 of the cushion body 1 for sitting can bend and deform (bending deflection deformation) in a favorable manner.

Expanded beads molded bodies are easy to form in molds even into complicated configurations so they are fairly economical and they have an excellent balance between lightweight properties and bending deflection characteristics. The base part 2 and the side supporting portions 3 may be formed of different materials, but, from the perspectives of excellent economy and stable physical properties, they are preferably made from an expanded beads molded body integrally in-mold molded using the same kind of material. In order to achieve excellent lightweight properties and good bending deflection characteristics, it is preferred that the expanded beads molded body has an apparent density of 15 to 120 kg/m$^3$, and more preferably from 20 to 90 kg/m$^3$. In particular, when using a polypropylene resin foam, an apparent density of 30 to 60 kg/m$^3$ is preferred.

When producing the cushion body 1 for sitting by in-mold molding of thermoplastic resin expanded beads, the manufacturing conditions are suitably controlled such that, regarding with the expanded beads molded body forming the cushion body 1 for sitting, the expanded beads molded body forming the sitting cushion body 1 shows a load of 10 to 150 N with a bending deflection of 20 mm when measured according to an operation described in JIS K 7221-1: 2006, and the expanded beads molded body shows a 25% compressive stress of 0.08 to 7 MPa when measured according to an operation described in JIS K 6767: 1999.

Here, the measurement of the load at the bending deflection of 20 mm is conducted using specimens cut out from the side supporting portion 3 and having a length of 120 mm, a width of 25 mm, and a thickness of 20 mm, and the measurement of the 25% compressive stress is conducted using specimens cut out from the base part 2.

Further, the thickness of the specimens for measuring the 25% compressive stress is controlled to 25 mm.

If specimens of the given dimensions cannot be cut out from the cushion body 1 for sitting, an expanded beads molded body is prepared using a material of the same quality as the cushion body 1 for sitting in order to have the same apparent density, and the measurement may be conducted using specimens cut out from this molded body.

The side supporting portions 3 of the cushion body 1 for sitting made of such an expanded beads molded body have elasticity and are capable of bending deformation, and can appropriately bend to fit the buttocks of the seated person while generating a sufficient reaction force to the seated person when the seated person/a user sits down on the cushion body, so as to come into close contact with a larger area of the buttocks. They thus demonstrate both a superior body pressure dispersing property and suitable supporting performance and can guide the seated person to a proper seated posture. This allows the seated person to sit with good feeling of sitting without discomfort even when sitting for a long time.

If the expanded beads molded body forming the cushion body 1 for sitting exhibits an excessively small load at a bending deflection of 20 mm, then a sufficient reaction force is not provided and the cushion body 1 for sitting of this embodiment cannot demonstrate its function sufficiently. On the other hand, if this load is too large, the cushion body 1 for sitting will generate an excessively strong reaction force and will be less likely to bend to fit the buttocks of the seated person, in which case it becomes more difficult for the cushion body 1 for sitting to come into close contact with the buttocks, resulting in that the body pressure dispersing property cannot be improved and good feeling of sitting cannot be obtained.

From these perspectives, it is preferred that the expanded beads molded body shows/exhibits a load of 20 to 120 N with a bending deflection of 20 mm when measured according to an operation described in JIS K 7221-1: 2006, and more preferably from 30 to 90 N.

If the expanded beads molded body forming the cushion body 1 for sitting exhibits an excessively small 25% compressive stress, then the base part 2 may deform too much when loaded with a body weight. Further, the boundaries between the base part 2 and the respective side supporting portions 3 will be less likely to function properly as the fulcra of deformation, and then the side supporting portions 3 is less likely to suitably bend and deform, resulting in that the cushion body 1 for sitting of this embodiment cannot demonstrate its function sufficiently. On the other hand, if this compressive stress is too large, the side supporting portions 3 is less likely to make proper bending deflection deformation when the base part 2 and the side supporting portions 3 are integrally formed by in-mold molding. Further, making the cushion body 1 for sitting be lightweight becomes difficult.

From these perspectives, it is preferred that the expanded beads molded body exhibits a 25% compressive stress of 0.1 to 6 MPa when measured according to the operations described in JIS K 6767:1999, and more preferably from 0.2 to 1 MPa.

In this embodiment, the base part 2 of the cushion body 1 for sitting is a part that is rested on the seat surface when the cushion body 1 for sitting is placed on the seat surface of an existing chair or the like. The base part 2 can be a block-like part formed in a substantially rectangular shape (including square shape) when viewed in plan and having the sitting surface S1 in its top surface. The bottom surface of the base part 2 may be configured corresponding to the seat surface on which the base part 2 is rested, but the bottom surface is preferably formed as a flat surface from the perspective of versatility.

Each side supporting portion 3 is formed integrally with the base part 2 so as to, like a cantilever, project obliquely upward from a side of the base part 2, with one end of the side supporting portion 3 coupled to the base part 2 and the other end being a free end. Thus, when a user sits down on the cushion body, the load applied to the side supporting surfaces S2 formed on the upper surfaces of the respective side supporting portions 3 enables the side supporting portions 3 to bend and deform downward at the connections with the base part 2 as a fulcrum while generating a reaction force, and they can recover into the original shape after the load has been removed.

In configuring the side supporting portions 3 to be able to bend and deform, it is preferred that they generate a reaction force of 16 N to 55 N when the outer ends of the side supporting portions 3 in the left-right direction of the cushion body 1 for sitting are pushed down by 10 mm with the base part 2 fixed.

For example, if the seated person is a child weighing 30 kg or less, it is preferable to set such that the reaction force is about 16 N.

If the seated person weighs 120 kg or more, it is preferable to set such that the reaction force is about 55 N.

If the seated person has a standard physical build with a weight of 40 to 90 kg, it is more preferable to set such that the reaction force is 28 to 36 N.

When the cushion body 1 for sitting is placed on a placing surface and supports the buttocks of a seated person, deformable areas are formed under the side supporting portions 3 so that the side supporting portions 3 can bend downward. The deformable areas are preferably formed as spaces, but may be formed as areas where a material (e.g., soft foam or stretched cloth, etc.), selected not to obstruct the bending and deformation of the side supporting portions 3 when they bend and deform downward, exists under the side supporting portions 3.

The side supporting surfaces S2 formed on top of the side supporting portions 3 are each formed of a curved surface that is curved obliquely upward continuously from the sitting surface S1 formed on top of the base part 2. The curved surfaces are configured concavely in order to fit the shape of the buttocks of the seated person together with the curved surface of the base part 2. These surfaces S1 and S2 are configured such that the base part 2 and the pair of side supporting portions 3 cooperate to support the buttocks of the seated person, with the sitting surface S1 formed on top of the base part 2 being in close contact with the central area of the buttocks of the seated person and with the side supporting surfaces S2 formed on top of the side supporting portions 3 being in close contact with the side areas of the buttocks of the seated person.

The sitting surface S1 formed on top of the base part 2 and the side supporting surfaces S2 formed on top of the side supporting portions 3 are configured to resemble the shape of the buttocks of a model having an average body shape of potential users. For example, the surfaces S1 and S2 can be formed based on the shape of the buttocks that is obtained, for example by, with an average Asian adult model being in a seated posture, patterning the shape of the buttocks not compressed (not deformed) in this situation or measuring the shape using a contact or noncontact three-dimensional measuring device.

Body shapes of humans vary infinitely and shapes of the buttocks in seated posture differ depending on the body shape such as skeletal structure or the amount of muscle, as well as gender and age. Accordingly, even with people having similar body shapes, their buttocks deform into different shapes when seated and compressed, depending on the amount of flesh and the like of the buttocks.

According to this embodiment, the entire cushion body 1 for sitting suitably bends to fit the buttocks of the seated person. Further, when the base part 2 and the pair of side supporting portions 3 cooperate to support the buttocks of the seated person, each side supporting portion 3 bends and deforms along the shape of the buttocks of the seated person. Moreover, the side supporting portions 3, when bent and deformed by a load applied onto the side supporting surfaces S2, come into close contact with and wrap the whole of the buttocks together with the base part 2, thus forming a concavity and supporting the whole of the buttocks to effectively disperse the body pressure of the seated person. It is thus possible to offer good feeling of sitting to many unspecified users with various body shapes and enable them to sit more comfortably.

Further, when the posture of the seated person changes and the body of the seated person inclines either to the left or right, a load to further push down one of the side supporting portions 3 acts on the side supporting surface S2 thereof. In this case, the side supporting portion 3 generates a reaction force against the load applied to the side supporting surface S2 to push back the inclination of the seated person's body. This guides the seated person to sit in a proper posture with less load on the body and also relaxes the muscles that unconsciously tense to keep the posture, which allows the seated person to sit comfortably in the proper posture for a long time.

It is preferred that a thickness of the side supporting portions 3 is 12 to 40 mm so that the side supporting portions 3 can recover in a favorable manner after the load has been removed and suitably bend and deform while generating a sufficient reaction force against a load applied to the side supporting surfaces S2.

The thickness of the side supporting portions 3 is defined as a length between the top and bottom surfaces of the side supporting portions 3 in the direction along the normal line of the side supporting surfaces S2.

A thickness of the base part 2 is suitably designed so that the sides of the base part 2 ensure a thickness that is necessary to integrally form the side supporting portions 3 with a thickness in the aforementioned range and so that, when the cushion body 1 for sitting is placed on the seat surface of, for example, an existing chair and a user sits on it, the user can be seated without feeling uncomfortable and without the sitting position being too high.

A minimum thickness of the base part 2 is preferably 6 mm or greater in order to allow the cushion body 1 for sitting to demonstrate sufficient strength and to prevent troubles like underfill, etc. Further, a maximum thickness of the base part 2 is preferably 50 mm or less in order to reduce the sitting height and to allow the cushion body 1 for sitting to be applied to various seat surfaces.

It is preferred that the bottom surfaces of the side supporting portions 3 are formed as curved surfaces that are curved in such a manner that the thickness of the side supporting portions 3 is within the aforementioned range and so that the bottom surfaces are shaped substantially the same as the shapes of the side supporting surfaces S2 formed in their upper surfaces. In order to facilitate the processing of the mold, the bottom surfaces of the side supporting portions 3 may be downwardly convex curved surfaces that curve with substantially constant curvatures respectively along the front-rear direction of the side supporting portions 3 and the projecting direction orthogonal thereto.

Further, each side supporting portion 3 may be provided as two or more divided sections, according to the directions of the load applied to a rear supporting surface S3. Forming it as two or more divided sections allows the individual divided sections to bend and deform without interfering with each other in accordance with the directions of the load applied to the side supporting surface S2.

By forming the bottom surface of each side supporting portion 3 in such a manner that the bottom surface curves, at the connection with the base part 2 at least, like a downwardly convex circular arc along the front-rear direction of the side supporting portion 3, it is possible to improve the strength of the connection and to obtain a more sufficient reaction force when the side supporting portion 3 bends and deforms due to the load applied to the side supporting surface S2.

A projecting length W3 of each side supporting portion 3 is preferably from 50 to 150 mm. Setting the projecting length W3 of the side supporting portions 3 within this range allows the side supporting portions 3 to readily bend and deform along the shape of the buttocks of the seated person.

A lateral width W1 of the cushion body 1 for sitting is suitably designed considering the shape of the buttocks of an adult with an average body shape of potential users, which may be from 300 to 500 mm, for example.

Setting the projecting length W3 of the left and right side supporting portions 3 within the aforementioned range allows the side supporting portions 3 to suitably bend and deform to fit the body of the seated person to certainly offer comfortable sitting, and also allows the cushion body 1 for sitting to be stably placed on the seat surface of an existing chair or the like. In order to allow the cushion body 1 for sitting to be placed more stably, a lateral width W2 of the base part 2 is preferably from 150 to 250 mm.

When the lateral width W1 of the cushion body 1 for sitting is defined as 100%, the ratio of the total of the projecting lengths W3 of the left and right side supporting portions 3 is preferably 25% or greater relative to this lateral width W1. Setting this ratio in this way allows the side supporting portions 3 to suitably bend and deform even with many unspecified users to offer a further improved body pressure dispersing property and supporting performance.

Further, in order to further improve the sitting comfort, the area for supporting the buttocks of the seated person may be increased so as to disperse the body pressure more effectively.

In this embodiment, when forming the sitting surface S1 formed on top of the base part 2 by resembling the shape of the buttocks of an adult with an average body shape of potential users, the sitting surface S1 includes a rear supporting surface S3 for supporting a rear part of the buttocks of the seated person in the seated posture, in order to guide the seated person to the proper sitting position in the front-rear direction, to cause the seated person to feel secure that his/her buttocks are wrapped and his/her hip is supported, and to contribute to further dispersion of the body pressure. That is, the top surface of a rear area of the base part 2, which is formed like a block in a substantially rectangular shape (including square shape) in a plan view, is curved obliquely upward toward the rear so as to form a concavity along the rear part of the buttocks of the seated person in the seated posture, in order to support the rear part of the buttocks of the seated person in the seated posture.

More specifically, the rear part of the buttocks of the seated person is located more rear than the ischial tuberosity position of the seated person.

Thus, providing the sitting surface S1 including the rear supporting surface S3 formed of a curved surface that is curved continuously from the sitting surface enables the buttocks of the seated person to be supported in an enlarged area and the body pressure to be dispersed more effectively. Furthermore, together with the fact that the sides of the buttocks of the seated person are supported by the side supporting portions 3, this allows the seated person to strongly feel as if the whole buttocks are wrapped and feel further secure. This combined effect further improves the comfort of sitting.

More specifically, the sides of the buttocks of the seated person are buttock areas located to the left or right with respect to the ischial tuberosity position of the seated person.

Further, when forming the sitting surface S1 so as to include the rear supporting surface S3, each side supporting portion 3 may include an extended part 30 having an auxiliary rear supporting surface S4, where each auxiliary rear supporting surface S4 is formed of a curved surface that is curved continuously from the side supporting surface S2 and configured, in cooperation with the rear supporting surface S3, to support the rear part of the buttocks of the seated person in the seated posture. The auxiliary rear supporting surfaces S4 can be formed to resemble, together with the other surfaces S1, S2 and S3, the shape of the buttocks of an adult with an average body shape of potential users, and they are each formed as a curved surface that curves concavely along the rear side of the buttocks of the seated person in the seated posture.

When such extended parts 30 are provided at the side supporting portions 3, the extended parts 30 each adjoin the side supporting portion 3 and its other end forms a free end. Accordingly, when the body weight is applied when a user sits on them, the side supporting portions 3 open to the left and right and the extended parts 30 move at the connections with the side supporting portions 3 as a fulcrum so as to open rearward. Thus, by deformations made simultaneously in different directions, the extended parts 30 bend and deform obliquely rearward with respect to the buttocks, allowing the body pressure to be dispersed more effectively and allowing the buttocks and the sitting surface to come in closer contact, thus causing the seated person to feel more strongly as if his/her whole buttocks are wrapped. Further, the extended parts 30 are bent and deformed downward by the load applied to the auxiliary rear supporting surfaces S4, without being interfered with by the section of the base part 2 where the rear supporting surface S3 is present. In this case, the extended parts 30, together with the side supporting portions 3, can also generate a reaction force to push back the inclination of the body of the seated person.

In order to further promote the aforementioned bending deflection deformations, it is preferred that the bottom surfaces of the extended parts 30 are curved, at least at the connections with the side supporting portions 3, like downwardly convex circular arcs along the left-right direction of the side supporting portions 3.

For the purpose of keeping the posture of the seated person stably, a thigh supporting part 4 having a thigh supporting surface S5 for supporting, from below, the thighs of the seated person in the seated posture may also be provided extending from the front of the base part 2.

In providing the thigh supporting part 4 extending from the front of the base part 2, it is preferred that the thigh supporting part 4 has a greater width than the base part 2.

When a user sits on the cushion body 1 for sitting, the cushion body 1 for sitting is fixed on the seat surface on which the cushion body 1 for sitting is placed, as the weight of the seated person presses the bottom surface of the base part 2 against the seat surface. In this case, the presence of the thigh supporting part 4, which is wider than the base part 2, provided extending from the front of the base part 2 causes the cushion body 1 for sitting to be pressed against the seat surface in a substantially T-shaped area. As a result, even if the seated person moves slightly on the cushion body 1 for sitting, inclining of the cushion body 1 for sitting on the seat surface to the left or right can be suppressed, which allows the seated person to keep their posture more stably. In order to offer these effects more effectively, it is preferred that the bottom surface of the thigh supporting part 4 is formed as a flat surface that is flush with the bottom surface of the base part 2.

In the example illustrated in the drawings, both the left and right ends of the thigh supporting part 4 are arranged in series respectively with the edges of the free ends of the side supporting portions 3, and a lateral width W4 of the thigh supporting part 4 substantially agrees with the lateral width W1 of the cushion body 1 for sitting. Then, side supports 40 which support the sides of the thighs of the seated person are provided to stand along the left and right ends of the thigh supporting part 4, whereby turning of the thighs outward can be restricted. In particular, when an elderly person with serious lower-back pain or weakened muscle power sits down thereon, this enables the seated person to relax more and feel further secure.

Further, it is preferred that a surface area of the thigh supporting surface S5 on the base part 2 side is curved obliquely upward toward the front continuously from the sitting surface S1 formed in the top surface of the base part 2 (see FIG. 7). With this configuration, the thigh supporting surface S5 is located higher than the deepest part of the sitting surface S1 formed in the top surface of the base part 2, so that the thighs of the seated person sitting on the cushion body 1 for sitting extend somewhat upward toward the front. As a result, it is possible to effectively prevent the sitting posture (called sacrum posture) where the buttocks and thighs slip excessively frontward and a large load acts on the sacrum, and to guide the seated person to sit in the proper posture where the pelvis is erected and the body suffers less load. Conventional soft cushion materials, even when structured in the same way, readily deform when subjected to pressure and may not be able to sufficiently exhibit an effect, but the expanded beads molded body of this embodiment has suitable rigidity and can sufficiently exhibit an effect.

This embodiment is suitable particularly when the cushion body 1 for sitting is placed and used on the seat surface of a seat of traveling means such as an automobile, wheelchair, etc.

A length L2 of the thigh supporting part 4 along the front-rear direction is suitably designed together with a length L1 of the base part 2 along the front-rear direction by considering the configuration, size, etc. of the seat surface on which the cushion body 1 for sitting will be placed, but it is not preferable to compress the hollows of the knees of the seated person to restrict the flow of blood in the legs and compress nerves to cause numbness.

In order to avoid such problems, it is preferred, in order to avoid the compression, that the front end of the thigh supporting part 4 is configured such that its thickness gradually decreases in a range of 60 mm to 120 mm from the back sides of the knees of the seated person (see FIG. 7).

When the cushion body for sitting is used on a common seat surface, such as the seat of a wheelchair, the length L1 of the base part 2 along the front-rear direction can be from 200 to 350 mm and the length L2 of the thigh supporting part 4 along the front-rear direction can be from 60 to 300 mm.

The ischial tuberosities are the parts where the weight of the upper half of the body concentrates most when seated. Further, large numbers of nerves and blood vessels concentrate in the ischial tuberosity area and a large number of muscles attach thereto. Accordingly, if sitting for a long time will keep compressing the ischial tuberosity area, it is likely to cause congestion and pain, and compressed nerves are likely to result in numbness, which will increase discomfort. A common measure for this problem can be placing a thick and soft cushion material on the seat surface on which the ischial tuberosities abut when seated. However, this increases the thickness of the seat cushion and hence the height of the sitting position, which will lower the convenience of the seat cushion placed and used on an existing chair.

In order to avoid such a problem, it is thus preferred that the sitting surface S1 formed on top of the base part 2 has a relief part 5 formed in the position corresponding to the ischial tuberosities of the seated person in the seated posture, in order to avoid compression of the ischial tuberosities.

Such a relief part 5 may be provided as a concavity provided in the sitting surface S1 concavely, or as a through hole provided penetrating through the base part 2, but providing the relief part 5 as a through hole is preferred because the relief part 5 can then be formed without changing the thickness of the base part 2.

In formation of the relief part 5, the area of the relief part 5 is preferably from 15 to 30% with respect to the total area of the surface supporting the buttocks of the seated person in the seat cushion (the total of the areas of the sitting surface S1, side supporting surfaces S2, rear supporting surface S3, and auxiliary rear supporting surfaces S4).

Note that this total area includes the area of the relief part 5.

Setting the area of the relief part 5 within this range alleviates the concentration of the body pressure onto the ischial tuberosity part and offers a further improved body pressure dispersing property without damaging sitting comfort.

In the example illustrated in the drawings, the relief part 5 formed as a through hole provided penetrating through the base part 2 is designed as described below to avoid inconvenience due to increasing thickness of the base part 2 and resulting higher sitting position.

Figure 8:
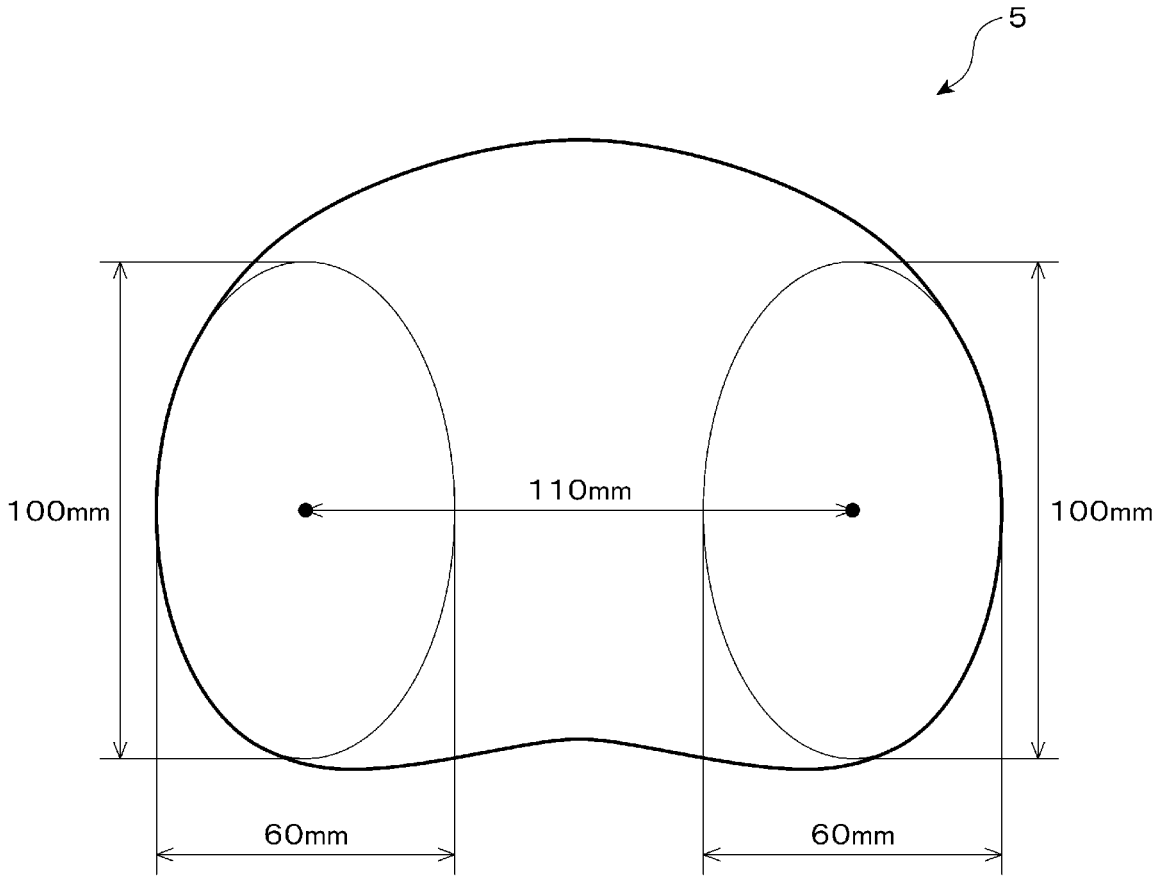
FIG. 8 An explanatory diagram illustrating a method for designing a relief part that is configured as a through hole provided penetrating through a base part.

That is, while the distance between the left and right ischial tuberosities varies depending on age, physical build, gender, etc., this distance is generally included in a range of approximately 70 to 150 mm in the cases of adults including teenagers. The relief part is designed by (see FIG. 8): setting the distance between the ischial tuberosities based on this range (110 mm in the example shown in the drawing); determining, on the basis of this distance, two points corresponding to the ischial tuberosities of the seated person in the seated posture; drawing, around these two points as the center, ellipses each having a shorter diameter of 40 to 90 mm (60 mm in the example of the drawing) along the shorter axis along the left-right direction and a longer diameter of 60 to 120 mm (100 mm in the example of the drawing) along the longer axis along the front-rear direction; and forming a through hole such that the through hole contains these two ellipses and such that the thickness of the perimeter of the through hole is in a range from 6 to 18 mm (10 mm in the example of the drawing) within which molding an expanded beads molded body is possible in general.

In particular, in the in-mold molding of the expanded beads molded body, forming the perimeter of the through hole having the thickness within the aforementioned range allows the ischial tuberosity part to be contained in the perimeter's opening, while maintaining the good feeling of sitting of the cushion body 1 for sitting, less increasing the height of the whole cushion body 1 for sitting.

Designing the relief part 5 in this way enables many unspecified users with various body shapes to be seated without their ischial tuberosities being compressed.

Further, even the same person will sit down in a slightly different position each time. Also, if the person keeps sitting for a long time, he/she will slightly move on the cushion body 1 for sitting to sit in a different position in some direction. It is possible to prevent the ischial tuberosity part from being compressed even in such cases.

Furthermore, when seated, the user will feel uncomfortable if the coccyx in the buttocks is compressed.

In order to avoid such a problem, it is preferred that the rear supporting surface S3 which supports a rear part of the buttocks of the seated person in the seated posture has a relief part 6 formed in a position corresponding to the coccyx of the seated person in the seated posture, in order to avoid compression of the coccyx.

Such a relief part 6 may be provided as a concavity provided in the rear supporting surface S3 concavely, or as a through hole provided penetrating through the base part 2; in the example of the drawing, the relief part 6 is provided as a concavity depressed in a position corresponding to the coccyx of the seated person in the seated posture (see FIG. 7).

While the cushion body 1 for sitting of the embodiment has been described, the cushion body 1 for sitting may be used, when needed, with a soft cushion material which is put on its top surface, for example, used while accommodated in a bag-like cloth cover or the like, in order to further improve the touch and the fit of the cushion body 1 for sitting and to make the cushion body 1 for sitting look more attractive to enhance its value as a product.

Second Embodiment

Next, a second embodiment of the present invention will be described.

Figure 9:
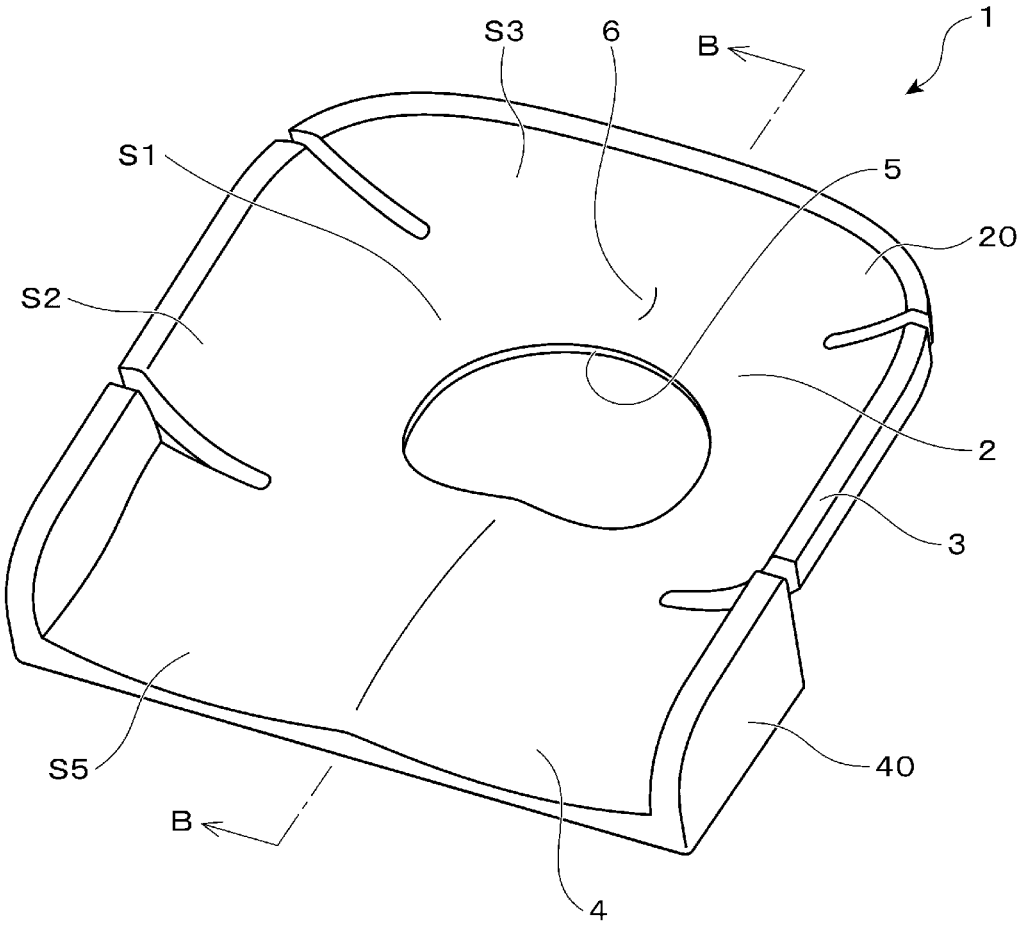
FIG. 9 A perspective view schematically illustrating a cushion body for sitting according to a second embodiment of the present invention.
Figure 10:
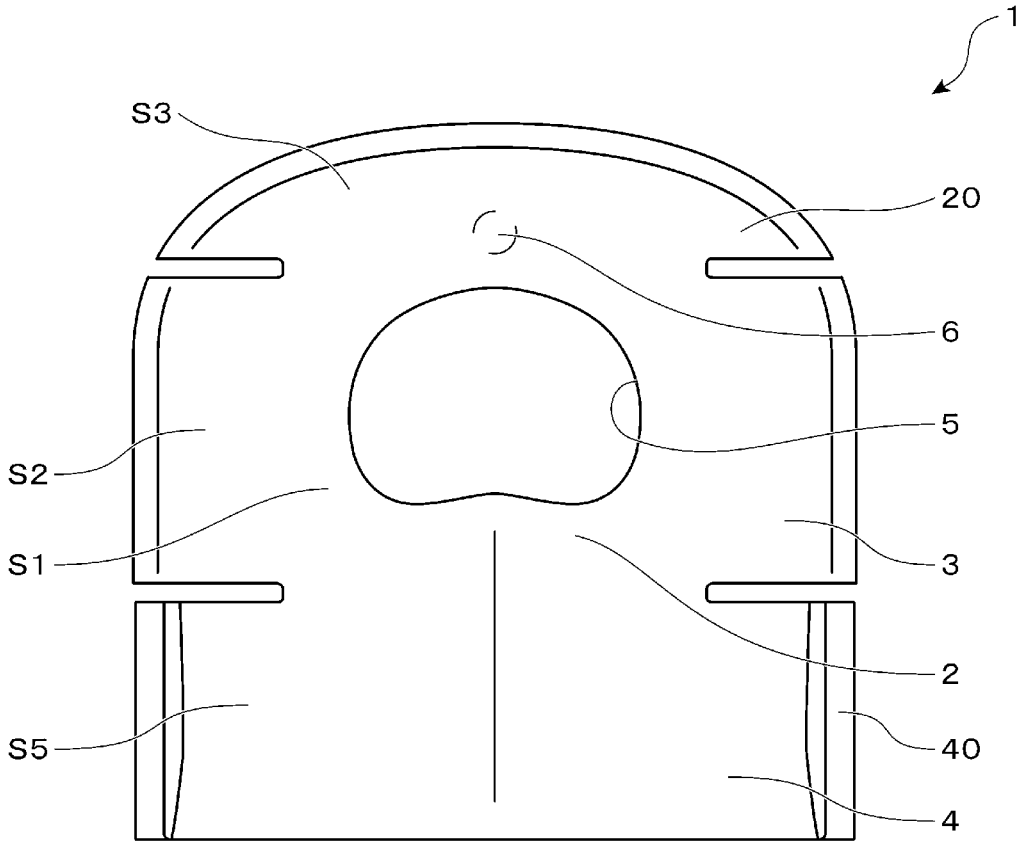
FIG. 10 A plan view schematically illustrating the cushion body for sitting according to the second embodiment of the present invention.
Figure 11:
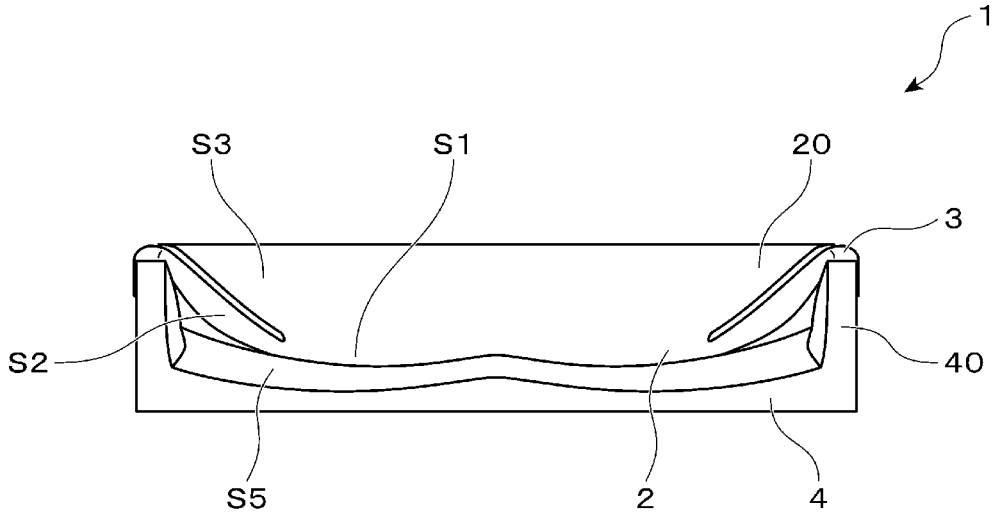
FIG. 11 A front view schematically illustrating the cushion body for sitting according to the second embodiment of the present invention.
Figure 12:
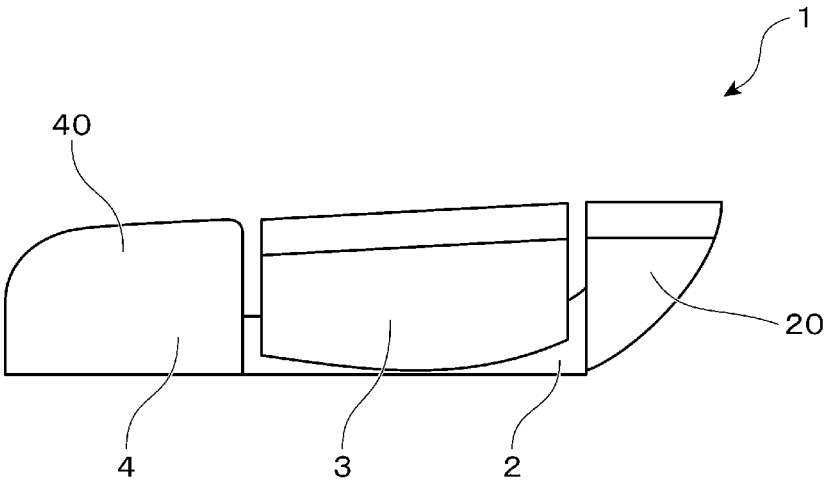
FIG. 12 A side view schematically illustrating the cushion body for sitting according to the second embodiment of the present invention.
Figure 13:
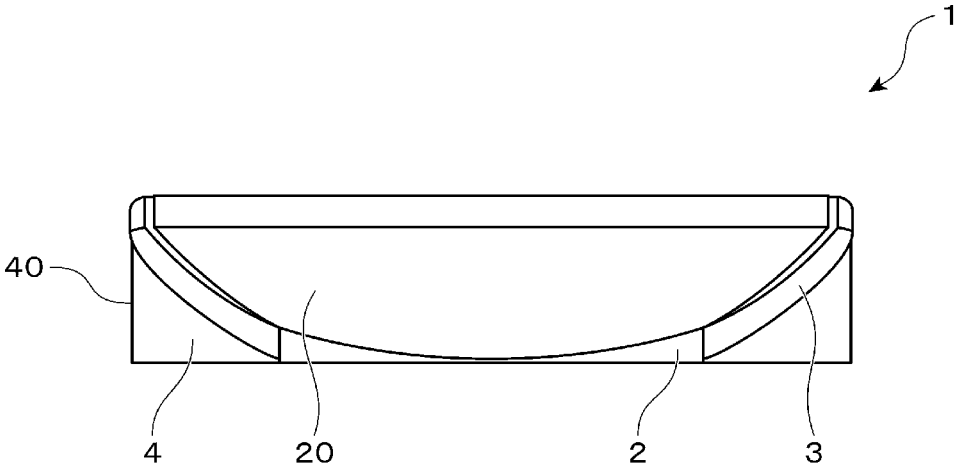
FIG. 13 A rear view schematically illustrating the cushion body for sitting according to the second embodiment of the present invention.
Figure 14:
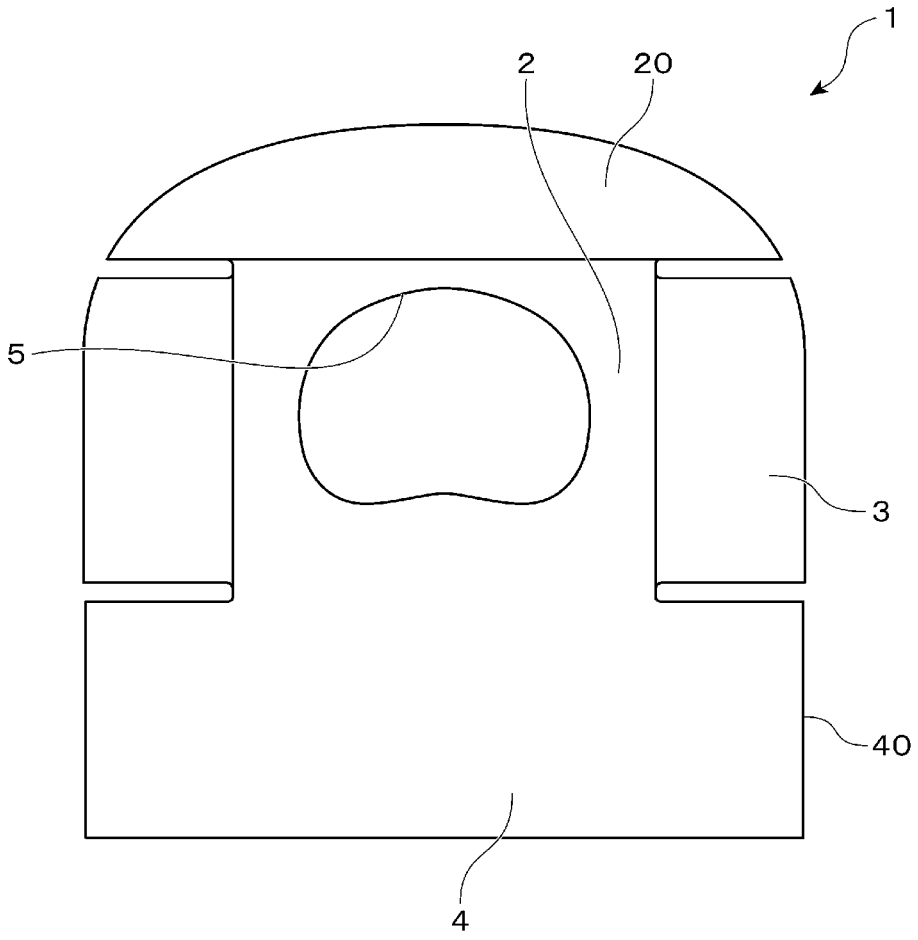
FIG. 14 A bottom view schematically illustrating the cushion body for sitting according to the second embodiment of the present invention.
Figure 15:
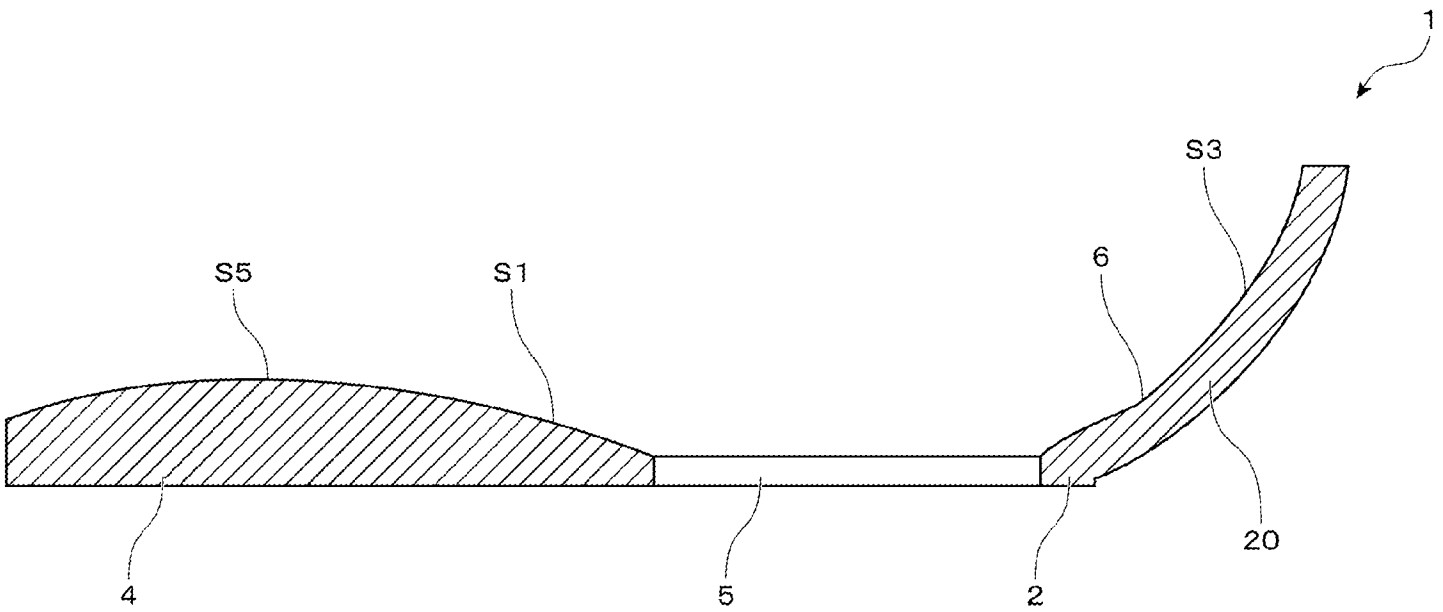
FIG. 15 An end view taken along line B-B in FIG. 9.

FIG. 9 is a perspective view schematically illustrating a cushion body 1 for sitting in accordance with this embodiment, FIG. 10 is a plan view thereof, FIG. 11 is a front view thereof, FIG. 12 is a side view thereof, FIG. 13 is a rear view thereof, FIG. 14 is a bottom view thereof, and FIG. 15 is an end view taken along line B-B in FIG. 9.

In the first embodiment described above, a rear section of the base part 2 is extended rearward and the rear supporting surface S3 is formed in the top surface of the extended section, in order to further support the rear part of the buttocks of the seated person in the seated posture.

In contrast, in this embodiment, a rear supporting portion 20 having a rear supporting surface S3 is formed integrally with the base part 2 to project from the rear of the base part 2, in order to support the rear part of the buttocks of the seated person in the seated posture.

That is, the cushion body 1 for sitting of this embodiment includes the rear supporting portion 20 having the rear supporting surface S3 formed of a curved surface that is curved continuously from the sitting surface S1, where the rear supporting portion 20 projects from the rear of the base part 2 in such a manner that it can be bent and deformed by a load applied to the rear supporting surface S3 in order to support the rear part of the buttocks of the seated person in the seated posture.

The rear supporting portion 20 is formed integrally with the base part 2 so as to, like a cantilever, project obliquely upward from the rear of the base part 2, with one end of the rear supporting portion 20 coupled to the base part 2 and the other end being a free end. Thus, when a user sits down and a load is applied to the rear supporting surface S3 formed in the top surface of the rear supporting portion 20, then the rear supporting portion 20 can bend and deform downward at the connection with the base part 2 as a fulcrum while generating a reaction force, and can recover into the original shape after the load has been removed.

The rear supporting surface S3 formed in the top surface of the rear supporting portion 20 is configured as a curved surface that is curved obliquely upward continuously from the sitting surface S1 formed in the top surface of the base part 2. As in the case of the rear supporting surface S3 of the first embodiment, the rear supporting surface S3, together with other surfaces S1 and S2, is configured concavely in order to fit the shape of the buttocks of the seated person resembling the shape of the buttocks of an adult with an average body shape.

This embodiment differs from the above-described first embodiment in including the rear supporting portion 20 molded integrally with the base part 2 to project from the rear of the base part 2, with the rear supporting surface S3 formed in its top surface to support a rear part of the buttocks of a seated person in the seated posture, and in omitting to provide the extended parts 30 provided at the side supporting portions 3. The configuration of this embodiment is common to that of the above-described first embodiment in other respects and will not therefore be further described again here.

According to this embodiment, the rear supporting portion 20 also bends and deforms along the shape of the buttocks of the seated person together with the side supporting portions 3 in supporting the buttocks of the seated person. Thus, even with many unspecified users with various body shapes, it is possible to more effectively disperse the body pressure so as to provide superior feeling of sitting and improved comfort while seated.

Furthermore, similar to the side supporting portions 3 attempting to push back the body of the seated person when the body of the seated person inclines leftward or rightward, the rear supporting portion 20 attempts to push back the body of the seated person when the body of the seated person inclines rearward, with a reaction force against the load applied to the rear supporting surface S3. This guides the seated person to be seated in the proper posture with less load on the body and enables the seated person to be seated more comfortably.

It is preferred that a thickness of the rear supporting portion 20 is from 12 to 40 mm so that the rear supporting portion 20 can stably recover after the load has been removed and suitably bend and deform while generating a sufficient reaction force against a load applied to the rear supporting surface S3. If the thickness of the rear supporting portion 20 is less than this range, there is the risk that a sufficient reaction force is not obtained and the rear supporting portion 20 cannot recover sufficiently after the load has been removed. On the other hand, if the thickness is over this range, bending deflection deformation may be hindered.

Note that the thickness of the rear supporting portion 20 refers to the length between the top and bottom surfaces of the rear supporting portion 20 along the normal line direction of the rear supporting surface S3.

It is preferred that the bottom surface of the rear supporting portion 20 is formed as a curved surface that is curved in such a manner that the thickness of the rear supporting portion 20 is within the aforementioned range and its bottom surface is shaped substantially the same as the shape of the rear supporting surface S3 formed on its top surface. Also, as in the case of the side supporting portions 3, in order to facilitate the processing of the mold, the bottom surface of the rear supporting portion 20 can be downwardly convex curved surface that curves with substantially constant curvatures respectively along the left-right direction of the rear supporting portion 20 and the projecting direction orthogonal thereto.

Also, as in the case of the side supporting portions 3, forming the bottom surface of the rear supporting portion 20 as a curved surface that curves, at the connection with the base part 2 at least, like a downwardly convex circular arc along the left-right direction of the rear supporting portion 20 improves the strength of the connection and offers a sufficient reaction force when the rear supporting portion 20 bends and deforms due to a load applied to the rear supporting surface S3.

Further, since the rear supporting portion 20 is coupled to the base part 2 and its other end is a free end, the rear supporting portion 20 opens rearward from the connection with the base part 2 when the rear supporting portion 20 is loaded with the body weight of the seated person. The rear supporting portion 20 can therefore come in closer contact with the buttocks and allow the seated person to feel as if his/her buttocks are wrapped.

In this embodiment, while the rear supporting portion 20 projects from the rear of the base part 2 and is bent and deformed by a load applied to the rear supporting surface S3, and the rear supporting portion 20 thus supports the rear part of the buttocks of the seated person in the seated posture, the rear part of the buttocks is curved. Accordingly, the directions in which the load is applied to the rear supporting surface S3 vary in different parts of the buttocks which the rear supporting surface S3 comes into close contact with; for example, the load is applied to its left side surface obliquely leftward, rearward, and downward, the load is applied to its central surface obliquely rearward and downward, and the load is applied to its right side surface obliquely rightward, rearward, and downward.

Figure 16:
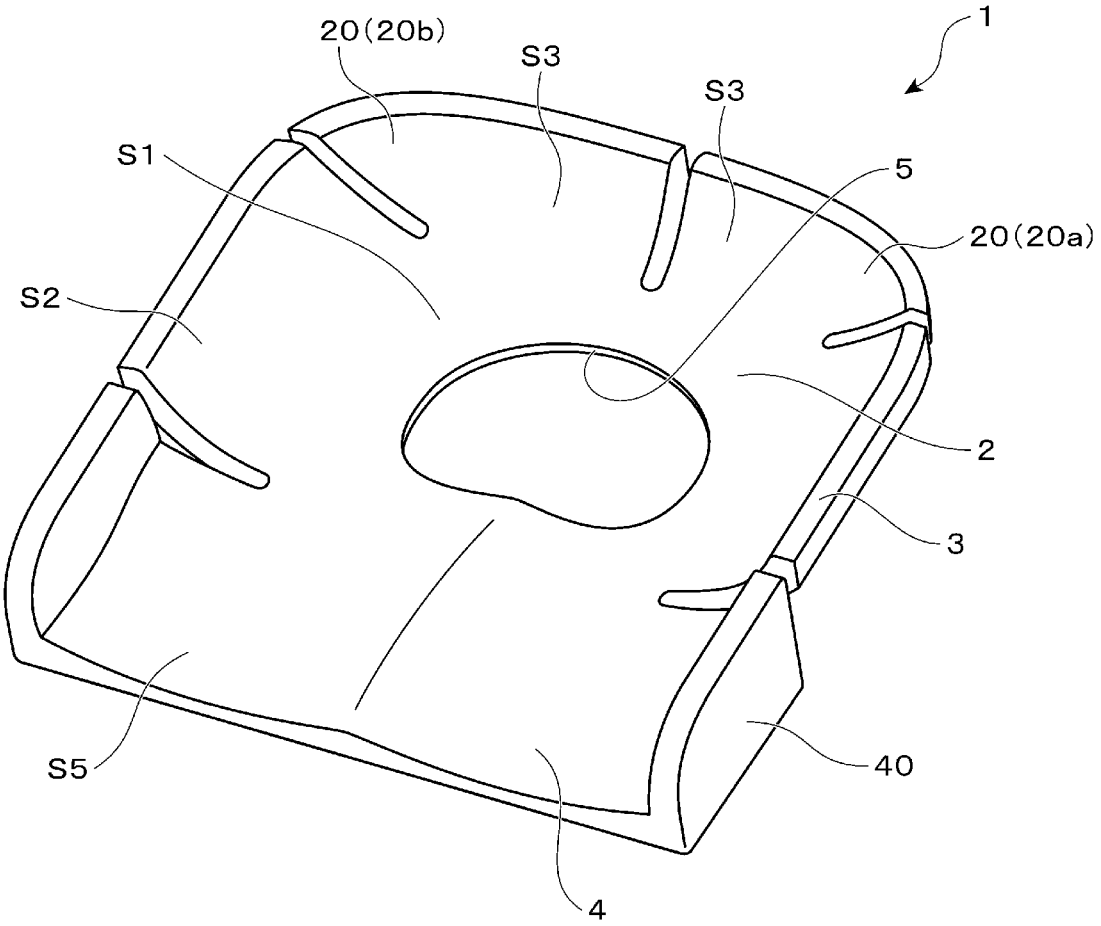
FIG. 16 A perspective view schematically illustrating a modification of the cushion body for sitting according to the second embodiment of the present invention.

Considering this situation, it is preferable to divide the rear supporting portion 20 into two or more sections according to the directions of the load applied to the rear supporting surface S3. For example, as shown in FIG. 16, the rear supporting portion 20 can be composed of left and right, two divided bodies 20*a*, 20*b*. This configuration allows each of the divided bodies 20*a*, 20*b* to bend and deform, without interfering with each other, according to the directions in which the load is applied to the rear supporting surface S3. As a result, each of the divided bodies 20*a*, 20*b* independently bends and deforms along the shape of the buttocks of the seated person and makes it possible to disperse the body pressure more effectively.

The example shown in FIG. 16 illustrates two divided bodies 20*a*, 20*b* provided in close vicinity to each other, but the interval between the two may be set larger, with one divided body 20*a* located to the left and the other divided body 20*b* located to the right. Though not shown, the rear supporting portion 20 may include three divided bodies on the left, central, and right sides, or may include a still larger number of divided bodies according to the directions in which the load is applied.

Third Embodiment

Next, a third embodiment of the present invention will be described.

Figure 17:
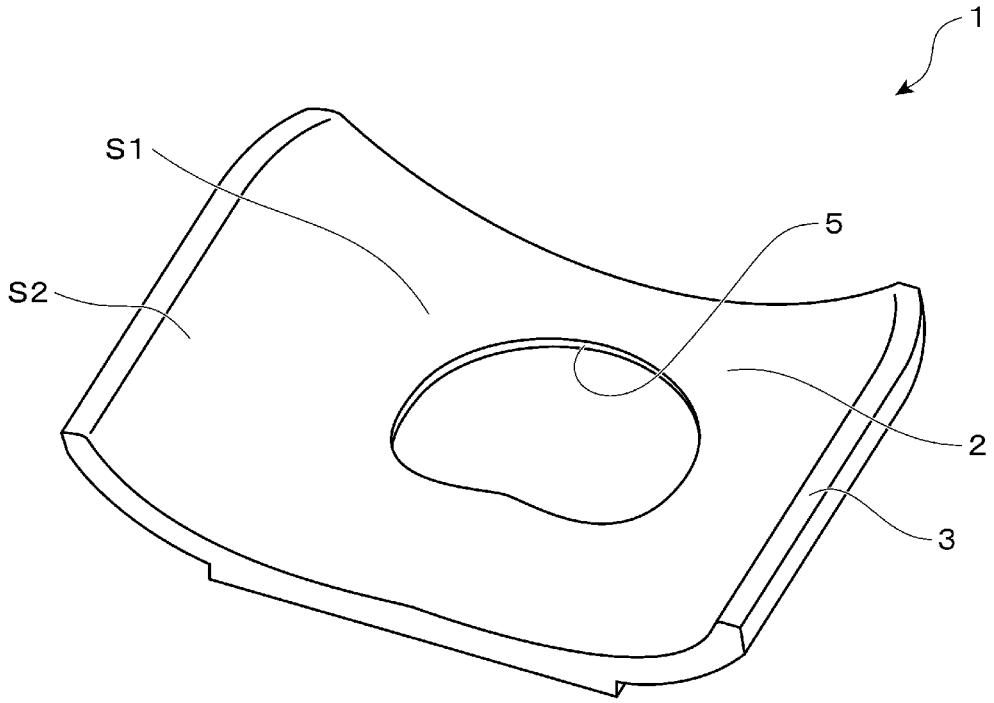
FIG. 17 A perspective view schematically illustrating a cushion body for sitting according to a third embodiment of the present invention.
Figure 18:
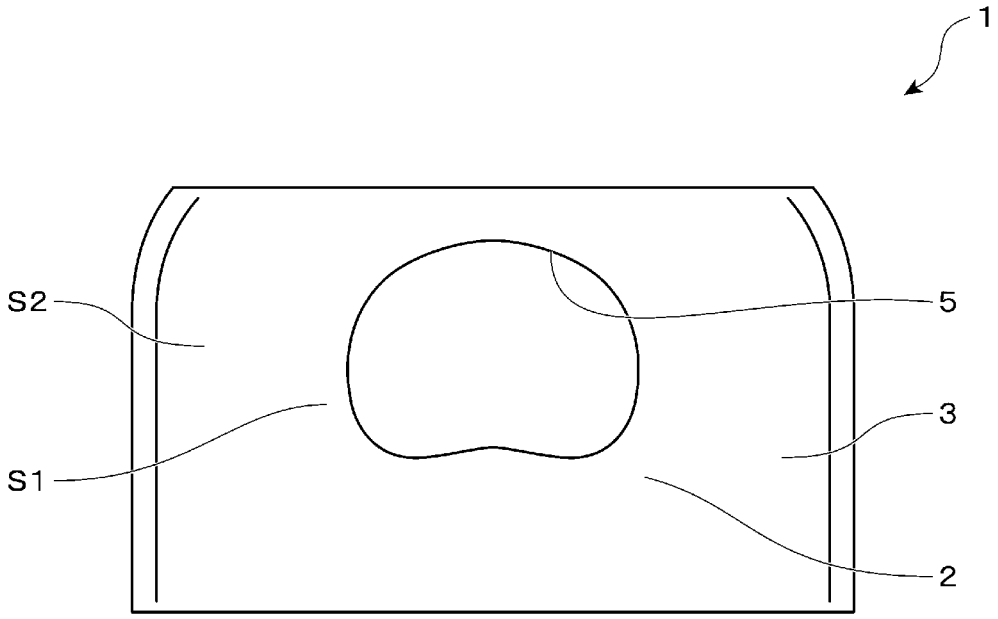
FIG. 18 A plan view schematically illustrating the cushion body for sitting according to the third embodiment of the present invention.
Figure 19:
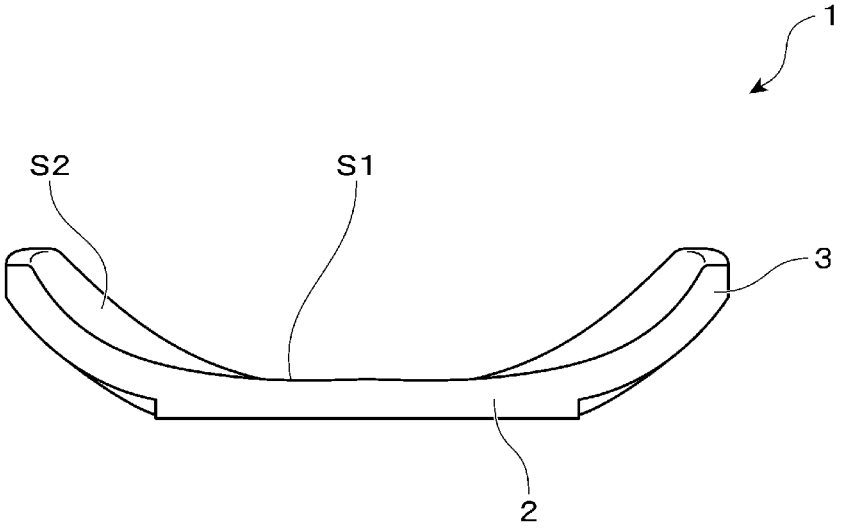
FIG. 19 A front view schematically illustrating the cushion body for sitting according to the third embodiment of the present invention.
Figure 20:
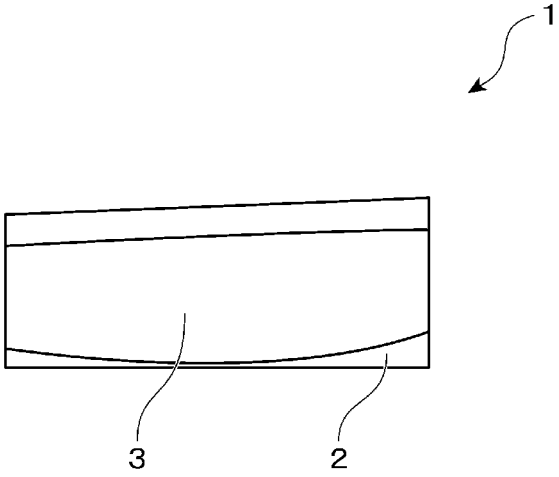
FIG. 20 A side view schematically illustrating the cushion body for sitting according to the third embodiment of the present invention.
Figure 21:
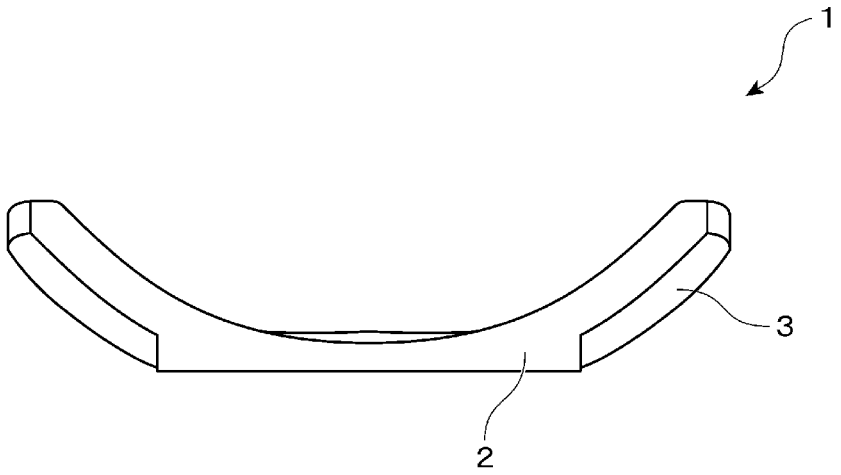
FIG. 21 A rear view schematically illustrating the cushion body for sitting according to the third embodiment of the present invention.
Figure 22:
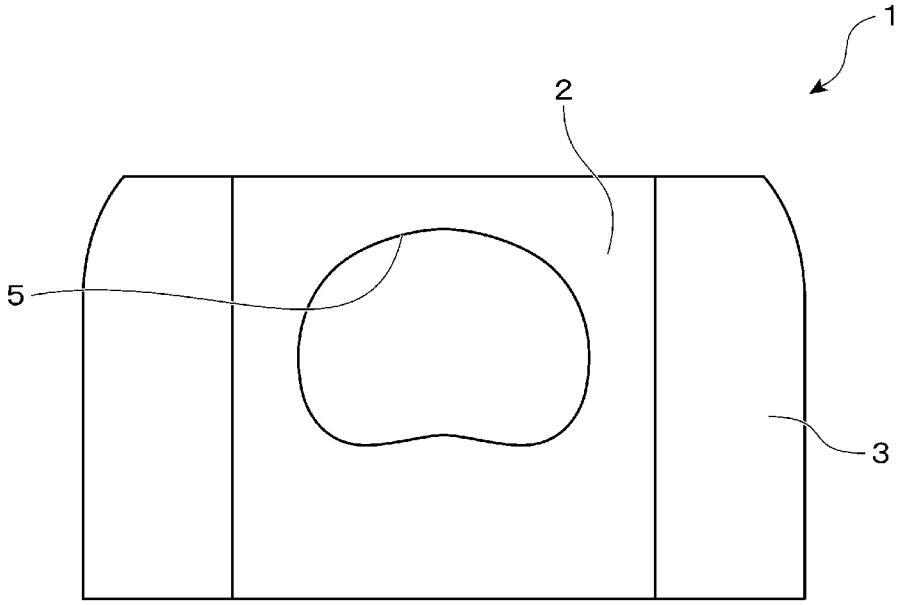
FIG. 22 A bottom view schematically illustrating the cushion body for sitting according to the third embodiment of the present invention.

FIG. 17 is a perspective view schematically illustrating a cushion body 1 for sitting in accordance with this embodiment, FIG. 18 is a plan view thereof, FIG. 19 is a front view thereof, FIG. 20 is a side view thereof, FIG. 21 is a rear view thereof, and FIG. 22 is a bottom view thereof.

In this embodiment, the thigh supporting part 4 and the rear supporting portion 20 of the above-described second embodiment are omitted.

That is, the cushion body 1 for sitting of this embodiment includes: a base part 2 having a sitting surface S1 formed of a curved surface that is curved concavely to support, from below, the buttocks of a seated person in a seated posture; and a pair of side supporting portions 3 each having a side supporting surface S2 formed of a curved surface that is curved continuously from the sitting surface S1 of the base part 2, where the pair of side supporting portions 3 project from the sides of the base part 2 such that the side supporting portions 3 can bend and deform with a load applied to the side supporting surfaces S2 to support both the left and right side parts of the buttocks of the seated person in the seated posture.

The specific configuration of these parts are common to those of the above-described first embodiment and will not therefore be further described again here.

This embodiment is the simplest embodiment of the present invention, can be easily carried, and is therefore particularly suitable for use on the seat surface of a leisure chair etc. in outdoor leisure activities such as camping or for use on the seat surface of a bench etc. installed in a stadium when watching sports.

The present invention has been described above with preferred embodiments, but the present invention is of course not limited only to the embodiments described above and various modifications are possible without departing from the scope of the present invention.

For example, the above-described embodiments have described examples of configuration that can be placed on the seat surfaces of existing chairs etc. so that users can sit on them more comfortably, but the cushion body for sitting of the present invention can be used as a core material embedded in the seats of automobiles, wheelchairs, etc.

EXAMPLE

A cushion body for sitting having the configuration of the first embodiment was produced.

The cushion body for sitting was configured as follows:

External shape of the cushion body for sitting (plan view): 390 mm (front-rear direction)×400 mm (left-right direction);

Expanded beads molded body: polypropylene resin foam (apparent density: 45 kg/m$^3$);

The expanded beads molded body showed a load of 33 N with a bending deflection of 20 mm, when measured according to an operation described in JIS K 7221-1: 2006;

The expanded beads molded body showed a 25% compressive stress of 0.28 MPa, when measured according to an operation described in JIS K 6767: 1999;

Thickness of the side supporting portions: 22 mm; and

Projecting length W3 of the side supporting portions: 120 mm.

Sitting on this cushion body for sitting was comfortable even over a long time.

The body pressure dispersing property of the cushion body for sitting of the example was evaluated using a sheet-type pressure distribution measuring device ("X3 Pro" produced by XSENSOR).

Specifically, a sitter (1) and a sitter (2) sat on the cushion body for sitting and the body pressure dispersing property was evaluated using the measuring device, where the sitter (1) was a woman weighing 45 kg and 160 cm tall and the sitter (2) was a man weighing 67 kg and 173 cm tall. The evaluation showed that the pressure was about 60 mmHg even in a position with the highest pressure distribution and proved that the body pressures of the seated persons could be dispersed suitably.

Further, a sitter (3) sat on the cushion body for sitting and the body pressure dispersing property was evaluated using the measuring device, where the sitter (3) was a man weighing 90 kg and 170 cm tall. The evaluation showed that the pressure was about 80 mmHg even in a position with the highest pressure distribution and proved that the body pressure of the seated person could be dispersed suitably.

As described above, it was confirmed that the cushion body for sitting of the present invention can exhibit good body pressure dispersing property with seated persons with various physical builds from small women (sitter (1)) to large men (sitter (3)).

REFERENCE SIGNS LIST

1 cushion body for sitting
2 base part
20 rear supporting portion
3 side supporting portion
30 extended part
4 thigh supporting part
40 side supports
5 relief part (for avoiding compression of the ischial tuberosities)
6 relief part (for avoiding compression of the coccyx)
S1 sitting surface
S2 side supporting surface
S3 rear supporting surface
S4 auxiliary rear supporting surface
S5 thigh supporting surface

The invention claimed is:

1. A cushion body for sitting made of an expanded beads molded body, comprising:

a base part having a sitting surface formed of a curved surface that is curved concavely to support, from below, the buttocks of a seated person in a seated posture; and a pair of side supporting portions each having a side supporting surface formed of a curved surface that is curved continuously from the sitting surface, and projecting from sides of the base part such that the side supporting portions can be bent and deformed outward by a load applied to the side supporting surfaces so as to support both left and right parts of the buttocks of the seated person in the seated posture, wherein deformable areas are formed under the side supporting portions so that the side supporting portions can bend downward, and wherein the expanded beads molded body shows a load of 10 to 150 N with a bending deflection of 20 mm, and the expanded beads molded body shows a 25% compressive stress of 0.08 to 7 MPa.

2. The cushion body for sitting according to claim 1, wherein the sitting surface includes a rear supporting surface configured to support a rear part of the buttocks of the seated person in the seated posture.

3. The cushion body for sitting according to claim 2, wherein the side supporting portions each include an extended part having an auxiliary rear supporting surface formed of a curved surface that is curved continuously from the side supporting surface, for supporting the rear part of the buttocks of the seated person in the seated posture together with the rear supporting surface.

4. The cushion body for sitting according to claim 1, further comprising a rear supporting portion having a rear supporting surface formed of a curved surface that is curved continuously from the sitting surface, wherein the rear supporting portion projects from a rear of the base part such that the rear supporting portion can be bent and deformed outward by a load applied to the rear supporting surface so as to support a rear part of the buttocks of the seated person in the seated posture.

5. The cushion body for sitting according to claim 1, wherein a thigh supporting part having a thigh supporting surface for supporting, from below, the thighs of the seated person in the seated posture is extended from a front of the base part, the thigh supporting part having a greater width than the base part.

6. The cushion body for sitting according to claim 5, wherein a surface section of the thigh supporting surface on the base part side is curved obliquely upward toward a front continuously from the sitting surface.

7. The cushion body for sitting according to claim 5, further comprising side supports standing along both left and right ends of the thigh supporting part.

8. The cushion body for sitting according to claim 5, wherein a back surface of the base part and a back surface of the thigh supporting part are formed as a flush and flat surface.

9. The cushion body for sitting according to claim 1, wherein the sitting surface includes a relief part located in a position corresponding to the ischial tuberosities of the seated person in the seated posture and configured to avoid compression of the ischial tuberosities.

10. The cushion body for sitting according to claim 1, wherein the rear supporting surface includes a relief part located in a position corresponding to the coccyx of the seated person in the seated posture and configured to avoid compression of the coccyx.

11. The cushion body for sitting according to claim 1, wherein the deformable areas comprise spaces or comprise a material that does not obstruct bending and deformation of the side supporting portions when they bend and deform downward.

12. The cushion body for sitting according to claim 11, wherein the deformable areas comprise spaces.

13. The cushion body for sitting according to claim 11, wherein the deformable areas comprise foam.

14. The cushion body for sitting according to claim 11, wherein the deformable areas comprise stretched cloth.

15. The cushion body for sitting according to claim 1, wherein the expanded beads molded body shows a load of 20 to 120 N with a bending deflection of 20 mm.

16. The cushion body for sitting according to claim 15, wherein the expanded beads molded body shows a 25% compressive stress of 0.1 to 6 MPa.

17. The cushion body for sitting according to claim 1, wherein the expanded beads molded body shows a 25% compressive stress of 0.1 to 6 MPa.

18. The cushion body for sitting according to claim 1, wherein the expanded beads molded body shows a load of 30 to 90 N with a bending deflection of 20 mm.

19. The cushion body for sitting according to claim 18, wherein the expanded beads molded body shows a 25% compressive stress of 0.2 to 1 MPa.

20. The cushion body for sitting according to claim 1, wherein the expanded beads molded body shows a 25% compressive stress of 0.2 to 1 MPa.

* * * * *